US010900267B2

(12) United States Patent
Mikesell

(10) Patent No.: US 10,900,267 B2
(45) Date of Patent: Jan. 26, 2021

(54) HINGE ARRESTING APPARATUSES

(71) Applicant: Brian Mikesell, Macy, IN (US)

(72) Inventor: Brian Mikesell, Macy, IN (US)

( * ) Notice: Subject to any disclaimer, the term of this patent is extended or adjusted under 35 U.S.C. 154(b) by 0 days.

(21) Appl. No.: 16/596,032

(22) Filed: Oct. 8, 2019

(65) Prior Publication Data

US 2020/0181962 A1 Jun. 11, 2020

Related U.S. Application Data

(60) Provisional application No. 62/777,934, filed on Dec. 11, 2018.

(51) Int. Cl.
*E05D 11/06* (2006.01)
*E05D 11/10* (2006.01)

(52) U.S. Cl.
CPC ..... *E05D 11/1014* (2013.01); *E05Y 2201/218* (2013.01)

(58) Field of Classification Search
CPC ..... E05D 11/06; E05D 11/10; E05D 11/1007; E05D 11/1028; E05D 11/1014; E05D 11/0054; E05D 2011/10; E05D 2011/1028; E05D 2201/1092; E05Y 2201/28; E05Y 2201/224; E05Y 2900/132; E05F 5/06; E05C 17/00; E05C 17/025; E05C 17/54; Y10T 16/61; Y10T 16/551
See application file for complete search history.

(56) References Cited

U.S. PATENT DOCUMENTS 3,206,793 A * 9/1965 Silverberg ..... E05C 19/003 16/223
3,971,100 A * 7/1976 Anop ..... E05C 19/184 16/375
5,265,922 A * 11/1993 Falcone ..... E05C 17/025 16/375
5,511,837 A * 4/1996 Dempsey ..... E05C 17/025 16/319
5,560,080 A 10/1996 Reed
5,969,607 A * 10/1999 Cox ..... E05C 19/18 292/258

(Continued)

OTHER PUBLICATIONS

"Defender Security Bronze U 11126 Door Reinforcement Lock", Defender Security, https://www.amazon.com/Defender-Security-11126-Door-Reinforcement/dp/B00QR2QCJI/ref=sr_1_2?e=UTF8&qid=1535562160&sr=8-2&(keywords=defender+security.

*Primary Examiner* — Chuck Y Mah

(57) ABSTRACT

Various embodiments for hinge arresting apparatuses are disclosed. The hinge arresting apparatus can include a first plate, arresting ribs, a second plate, and an elongated fastener. The first plate comprising a first longitudinal face. The arresting ribs each: includes a first-, second-, and a mid-section; each oriented perpendicularly to and affixed to the first longitudinal face of the first plate. The second plate includes an orifice and a second longitudinal face affixed to the second section of each of the arresting ribs. The orifice includes a threaded inner surface. An elongated fastener is positioned within the orifice and includes a threaded external surface complementary to the threaded inner surface. Each mid-section includes a notch configured to transition over a hinge knuckle. The elongated fastener extends through the orifice and contacts a leaf of the hinge when rotated in a predetermined direction and thereby arrest axial rotation thereof.

9 Claims, 10 Drawing Sheets

(56) References Cited

U.S. PATENT DOCUMENTS

| | | | | |
|---|---|---|---|---|
| 6,702,341 | B1 | 3/2004 | Hudelson et al. | |
| 7,559,114 | B2 * | 7/2009 | Ranilovich | E05C 17/025 16/374 |
| 7,904,992 | B2 * | 3/2011 | Agster | E05D 11/1014 16/82 |
| 8,281,459 | B2 | 10/2012 | Le et al. | |
| 8,678,453 | B2 * | 3/2014 | Caliguri | E05C 17/025 292/288 |
| 9,670,706 | B2 * | 6/2017 | Ching | E05D 11/00 |
| 9,988,833 | B2 * | 6/2018 | Powell | E05F 5/02 |
| 10,415,281 | B2 * | 9/2019 | Enos | E05B 35/008 |
| 2011/0018287 | A1 * | 1/2011 | Wise | E05D 11/10 292/288 |
| 2015/0008684 | A1 | 1/2015 | Ching | |
| 2016/0194909 | A1 * | 7/2016 | Karcher | E05D 11/06 16/374 |

* cited by examiner

HINGE ARRESTING APPARATUSES

CROSS-REFERENCE TO RELATED APPLICATIONS

This application claims priority to U.S. Provisional Application No. 62/777,934 filed Dec. 11, 2018, which is hereby incorporated herein by reference.

FIELD OF THE INVENTION

The present invention relates generally to arresting apparatuses and specifically to hinge arresting apparatuses.

BACKGROUND OF THE INVENTION

A hinge typically refers to a movable joint or mechanism on which a door, gate, or lid swings as it opens and closes, or which connects linked objects. Two objects connected by an ideal hinge rotate relative to each other about a fixed axis of rotation: all other translations or rotations being prevented, and thus a hinge has one degree of freedom. Hinges may be made of flexible material or of moving components. Hinges typically allow motion through a limited arc but can be configured to permit motion through nearly 360 degrees. Although there are many types of hinges, some hinges rely on a pivot pin and loop or barrel to provide the swinging motion through the arc.

BRIEF DESCRIPTION OF THE DRAWINGS

Some of the embodiments will be described in detail, with reference to the following figures, wherein like designations denote like members.

DETAIL DESCRIPTIONS OF THE INVENTION

Figure 1:
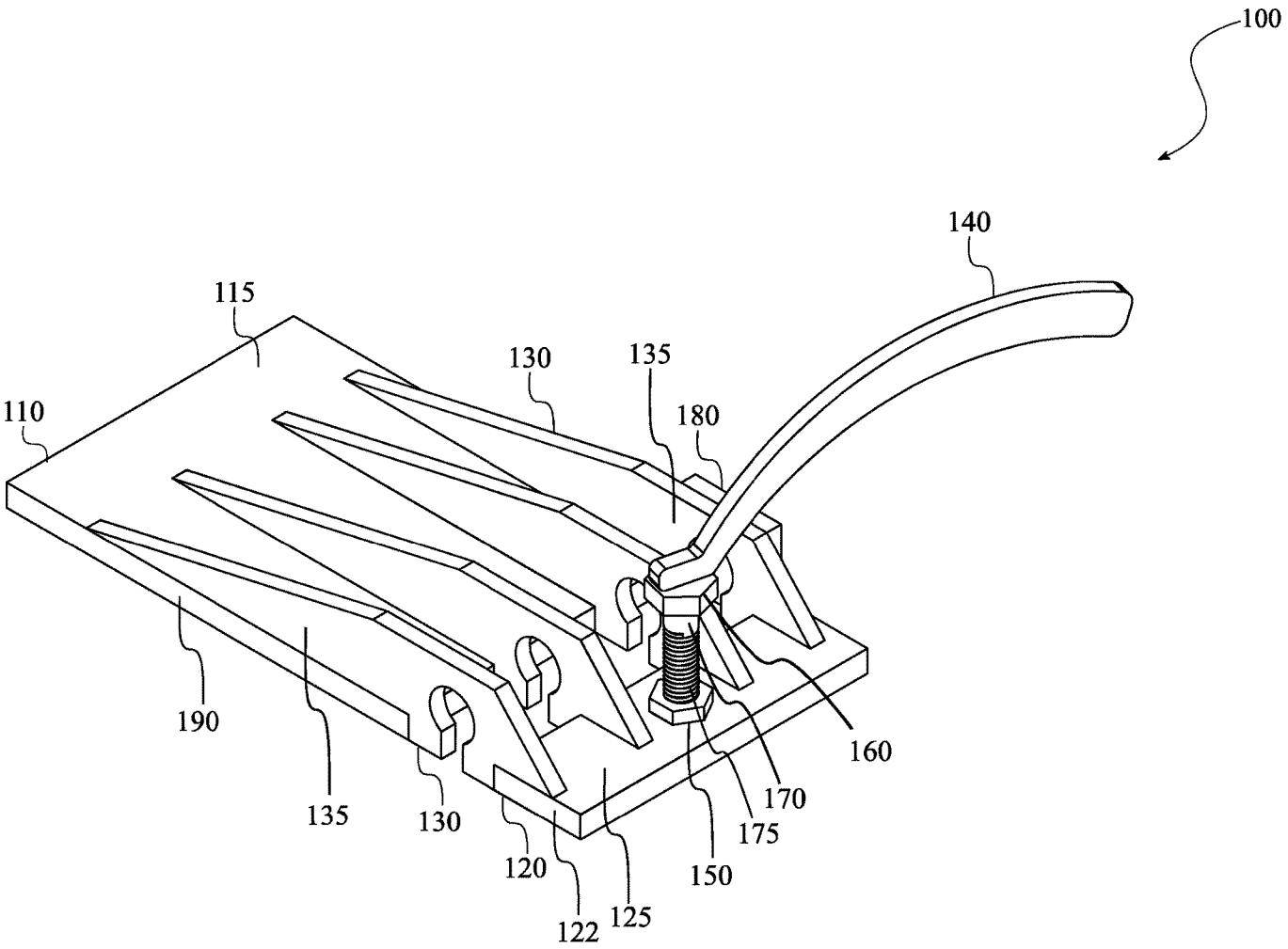
FIG. 1 illustrates a top front rear perspective view of a hinge arresting apparatus according to some embodiments.
Figure 2:
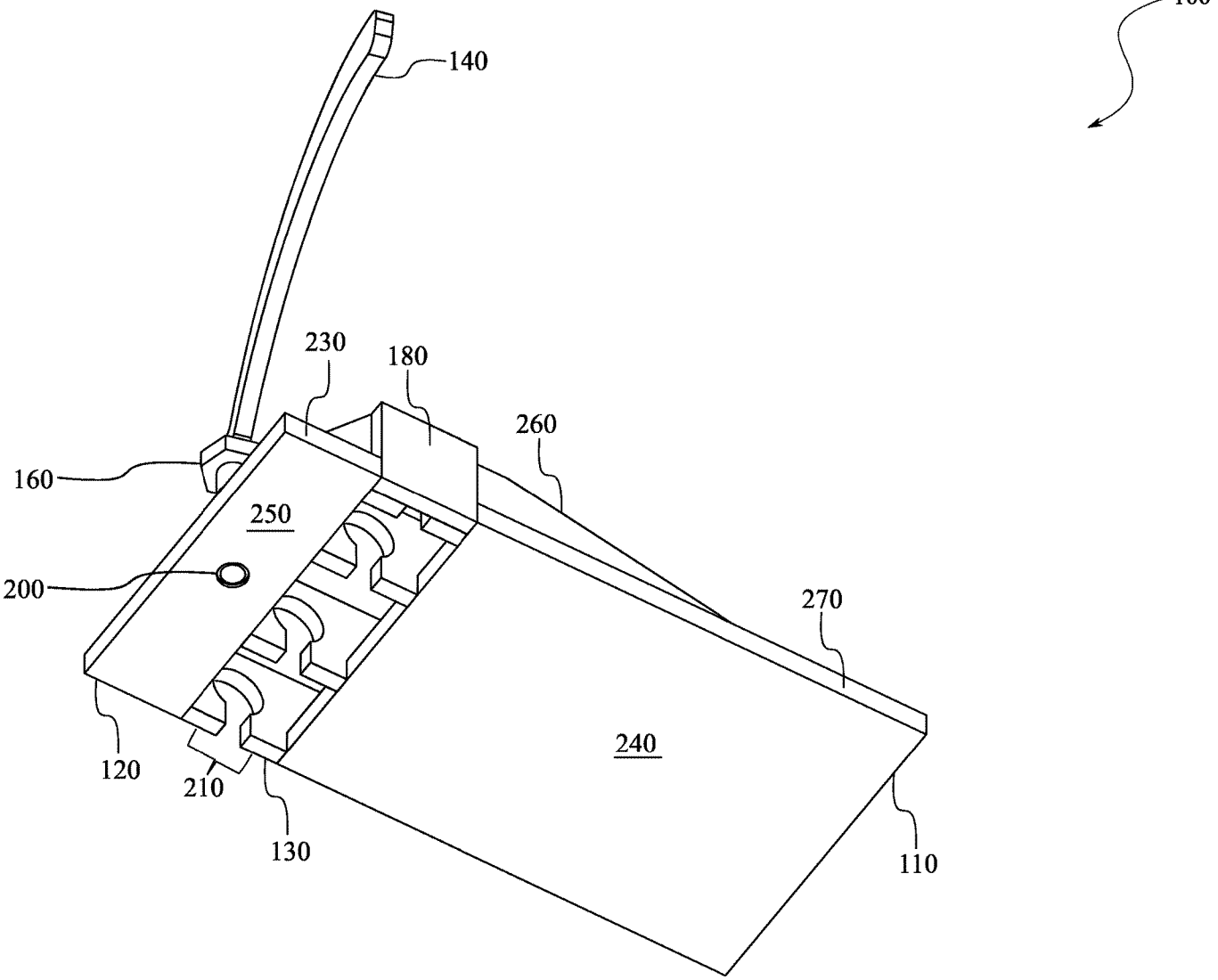
FIG. 2 illustrates a rear bottom perspective view of the hinge arresting apparatus according to some embodiments.
Figure 3:
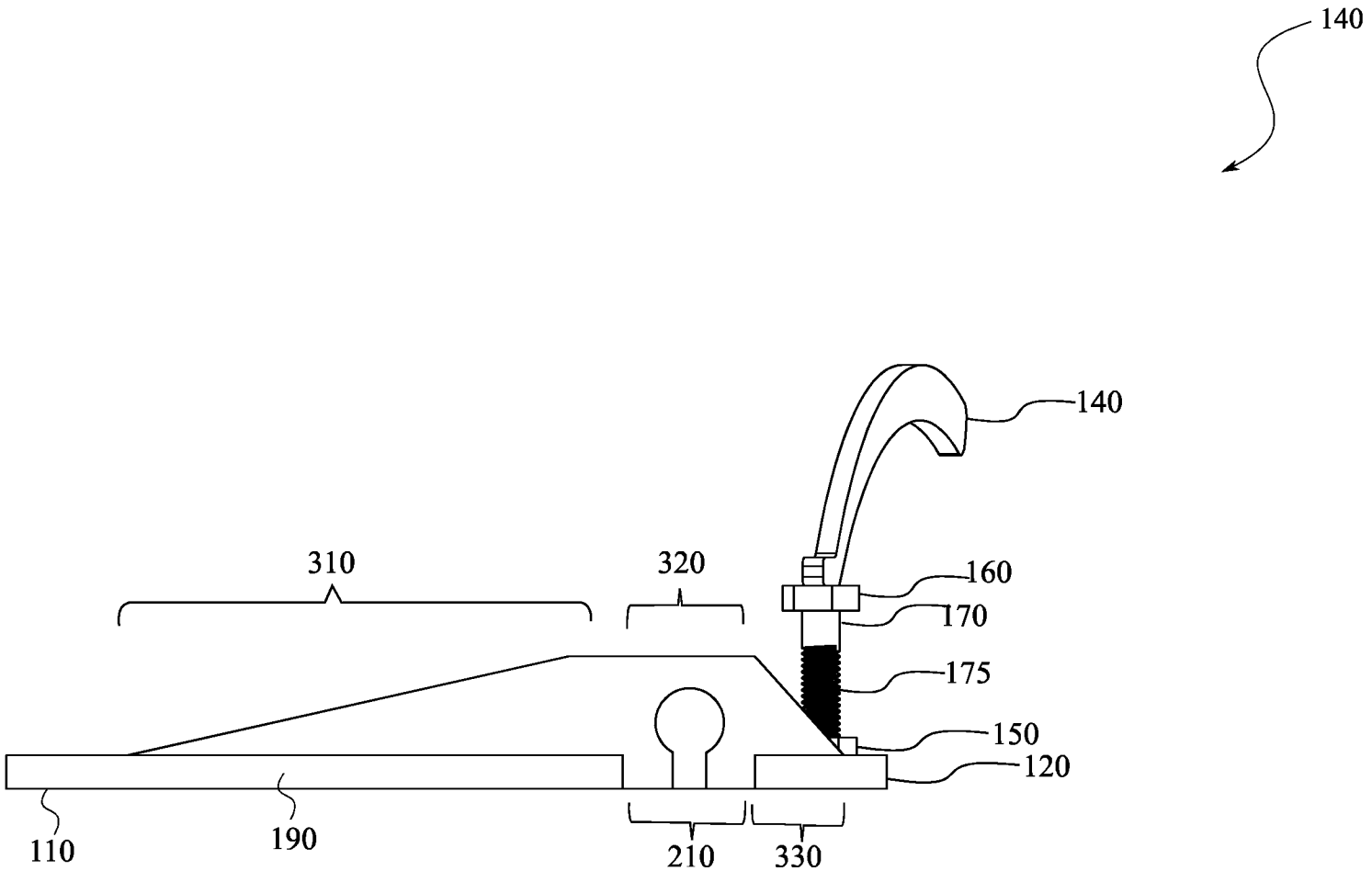
FIG. 3 illustrates a side view of the hinge arresting apparatus according to some embodiments.
Figure 4:
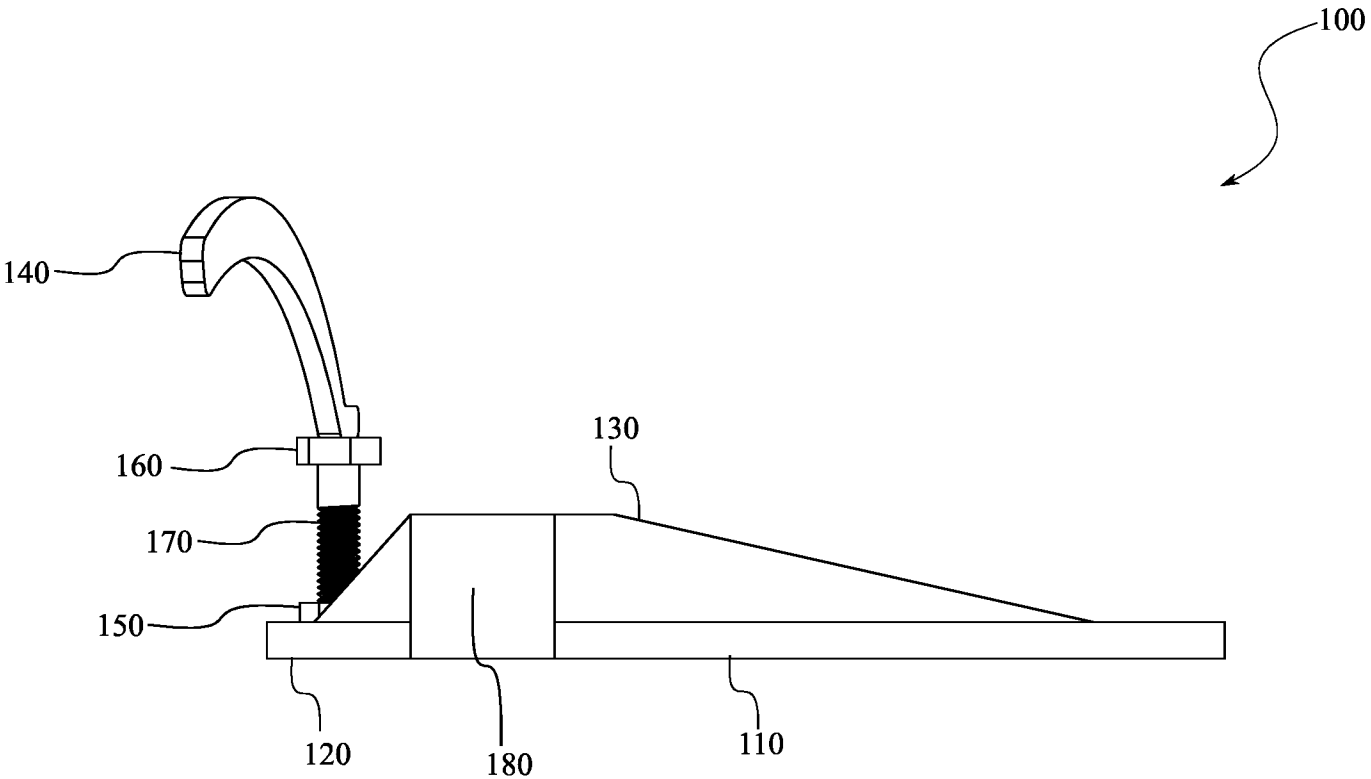
FIG. 4 illustrates a side view of the hinge arresting apparatus according to some embodiments.
Figure 5:
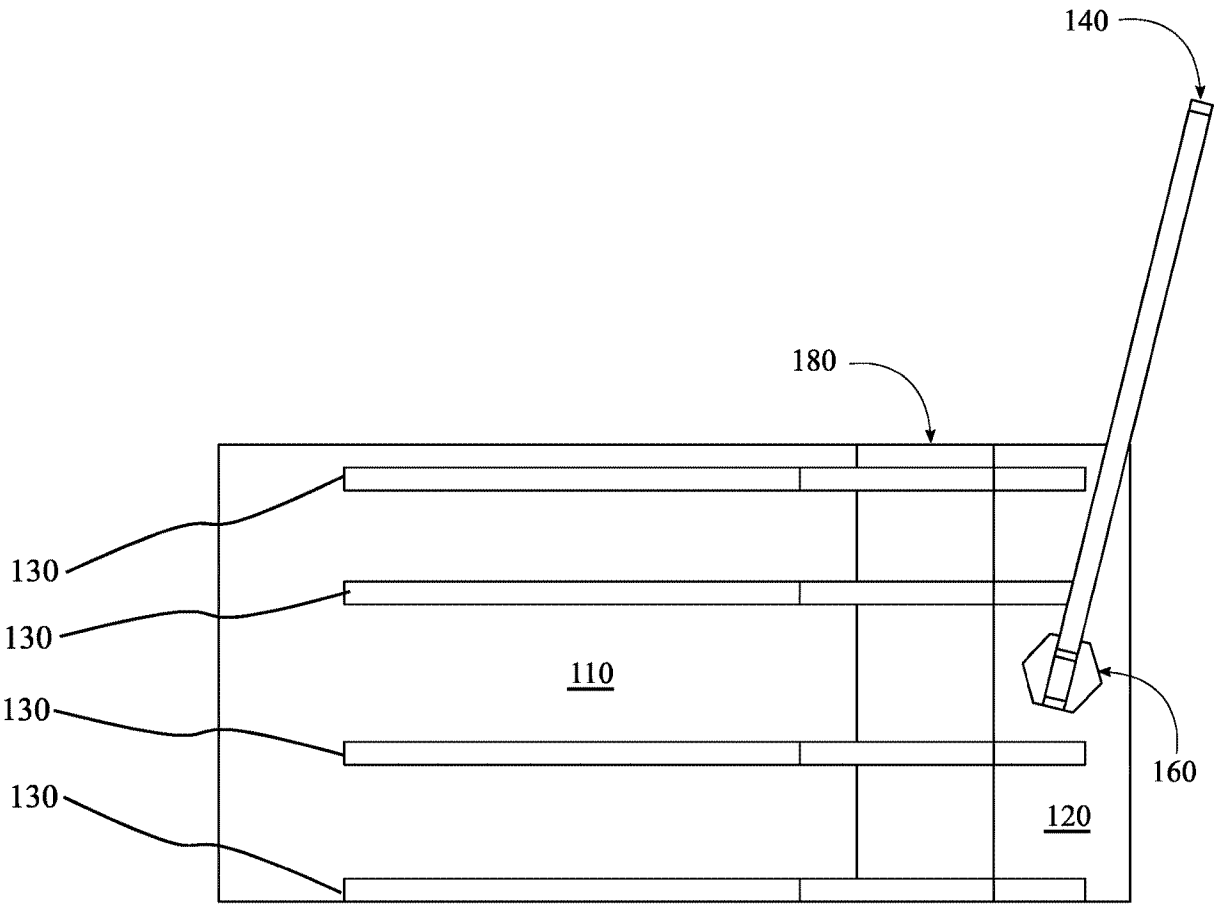
FIG. 5 illustrates a top view of the hinge arresting apparatus according to some embodiments.
Figure 6:
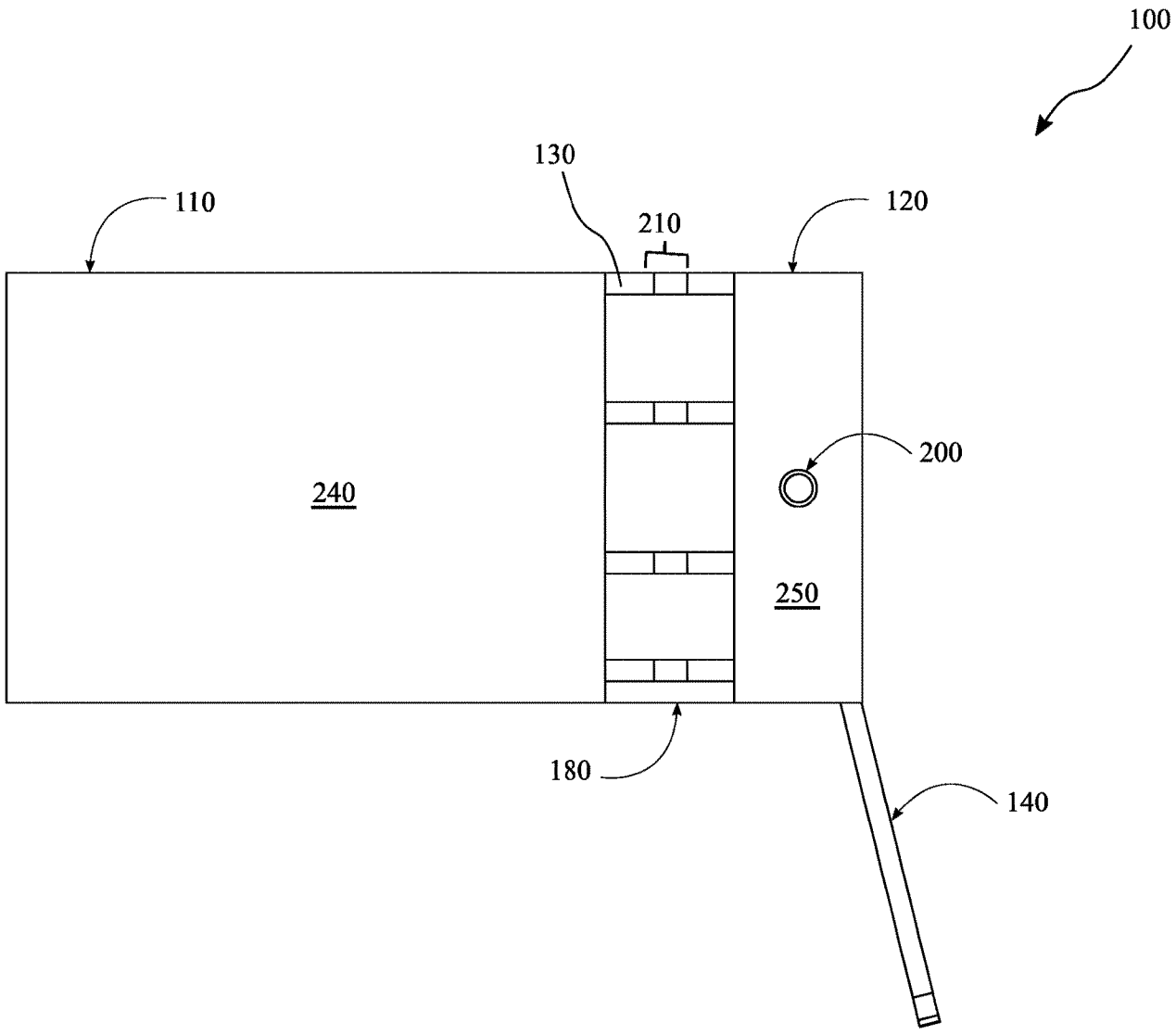
FIG. 6 illustrates a bottom view of the hinge arresting apparatus according to some embodiments.
Figure 7:
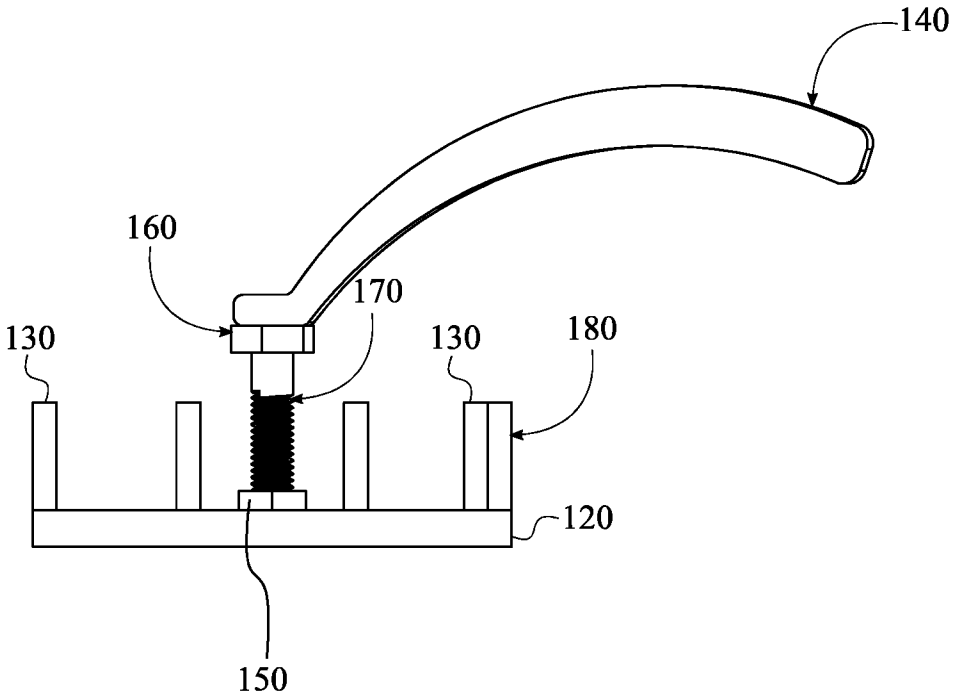
FIG. 7 illustrates a front view of the hinge arresting apparatus according to some embodiments.
Figure 8:
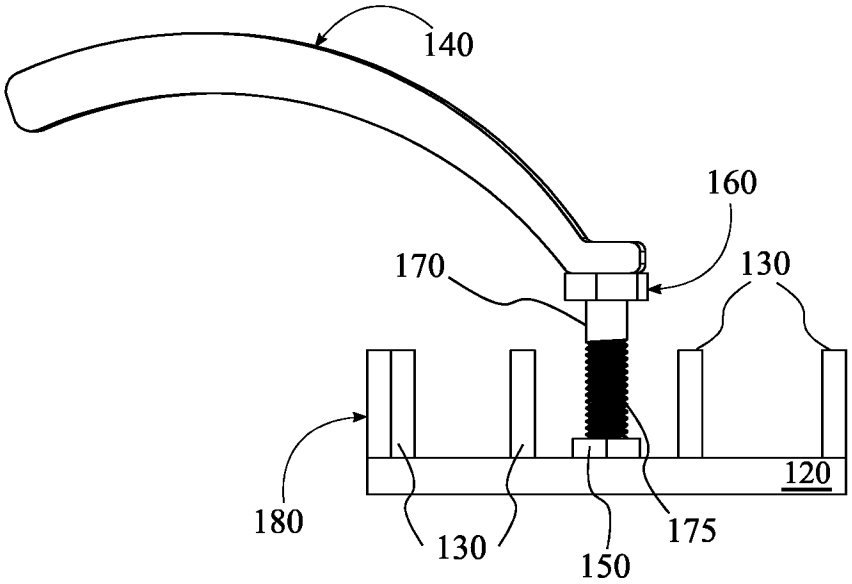
FIG. 8 illustrates a rear view of the hinge arresting apparatus according to some embodiments.

All illustrations of the drawings are for the purpose of describing selected versions of the present invention and are not intended to limit the scope of the present invention.

As a preface to the detailed description, it should be noted that, as used in this specification and the appended claims, the singular forms "a," "an" and "the" include plural referents, unless the context clearly dictates otherwise.

Embodiments of the present disclosure, for example, are described above with reference to operational illustrations of apparatuses according to embodiments of the disclosure. Embodiments disclosed herein seek to disclose hinge arresting apparatuses.

A hinge typically refers to a movable joint or mechanism on which a door, gate, or lid swings as it opens and closes, or which connects linked objects. Two objects connected by an ideal hinge rotate relative to each other about a fixed axis of rotation: all other translations or rotations being prevented, and thus a hinge has one degree of freedom. Hinges may be made of flexible material or of moving components. Hinges typically allow motion through a limited arc but can be configured to permit motion through nearly three-hundred and sixty (360) degrees. Although there are many types of hinges, some hinges rely on a pivot pin and loop or barrel to provide the swinging motion through the arc.

In reference to FIGS. 1-8, embodiments disclosed herein seek to convey a hinge arresting apparatus (hereinafter "HAA"), generally 100, configured to be positioned over most conventional hinges and thereby restrict pivotal rotation of the hinge as well as components affixed to the hinge.

In some aspects, HAA 100 can include first plate 110 and second plate 120 affixed to each other via four (4) arresting ribs 130. Not to be limited by theory, HAA 100 experiences exceptional structural loads during operation as it restricts the pivotal rotation of the hinge. As such, HAA 100 must be fabricated in a manner to resist the stresses, deformations, and/or displacements that can result from such loads. As such, the components of HAA 100 are assembled via a conventional welding technique (e.g., to ensure structural integrity). In other embodiments, HAA 100 is assembled via another fabrication/assembly methods (e.g., fastening, machining, forging, casting, similar methods, or a combination of two or more thereof).

First plate 110, second plate 120, arresting ribs 130, or both can be fabricated from metals (e.g., steel, brass, metal alloys, and/or similar metals), polymers (e.g., high impact polymers), or both. For example, first plate 110, second plate 120, and arresting ribs 130 can each be substantially planar plates of more or less uniform thickness. In some embodiments, first plate 110 and second plate 120 have uniform widths. Other aspects of first plate 110 include longitudinal faces 115 and 240 as well as lateral surfaces 190 and 270. Certain aspects of second plate 120 include orifice 200, longitudinal faces 125 and 250, as well as lateral surfaces 122 and 230. Some aspects of arresting rib 130 include first section 310, second section 330, mid-section 320 as well as longitudinal faces 135 and 400.

In some embodiments, first plate 110 is positioned coplanar with second plate 120. Longitudinal face 135 of each arresting rib 130 is oriented perpendicular to longitudinal faces 115 and 125 of first plate 110 and 120, respectively, according to some embodiments. For example, first plate 110 can be affixed to the bottom surface of first section 310 and second plate 120 can be affixed to the bottom surface of second section 330. In certain embodiments, HAA 100 includes four (4) copies of arresting ribs 130. In other embodiments, HAA 100 includes a plurality of arresting ribs 130 evenly spaced relative to each other when three or more arresting ribs 130 are present. Aspects of arresting rib 320 include a scalene trapezoidal profile (e.g., a trapezoid having no sides of equal measure) where first plate 110 and second plate 120 are each affixed to a leg (e.g., first section 310 and second section 330, respectively) of the trapezoid.

Aspects of mid-section 320 include notch 210, which is an indentation in the sidewall of arresting rib 130 (i.e. notch 210 is an indentation or incision positioned on the planar surface of arresting rib 130). Some aspects of notch 210 include a tapered mouth configured to frictionally engage the hinge knuckle of a conventional hinge when the elongated fastener frictionally engage the leaf.

In yet still other embodiments, the main body of HAA 100 includes first plate 110, second plate 120, and a plurality of arresting ribs 130. For example, elongated fastener 170 secures the main body to hinge 900 (discussed further below), or a door assembly that includes hinge 900.

Furthermore, numerous other types of reinforcing supports may be used to restrict angular movement of the first plate 110 relative to second plate 120 without departing from the scope of the invention. Some aspects of midsection 320 include substantially planar surfaces and hinge slot 210. In certain embodiments, second section 330 has an overall triangular side profile. For example, midsection 320 is positioned adjacent to second section 330.

Figure 9:
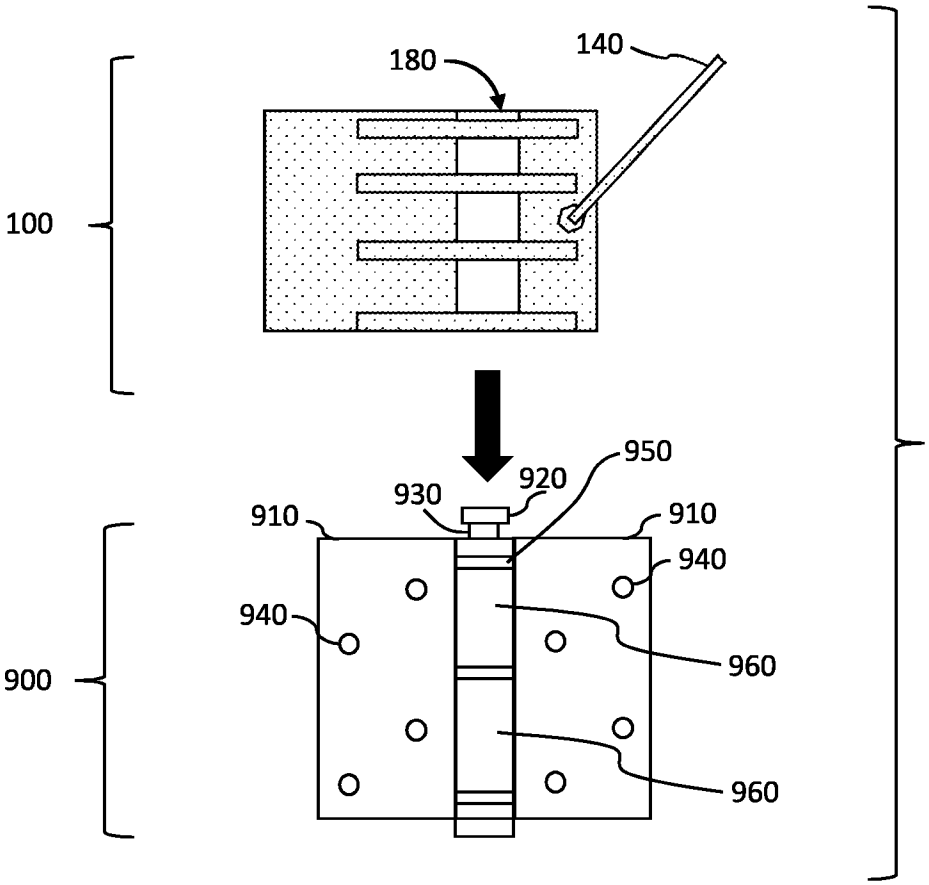
FIG. 9 illustrates an operation of the hinge arresting apparatus according to some embodiments.
Figure 10:
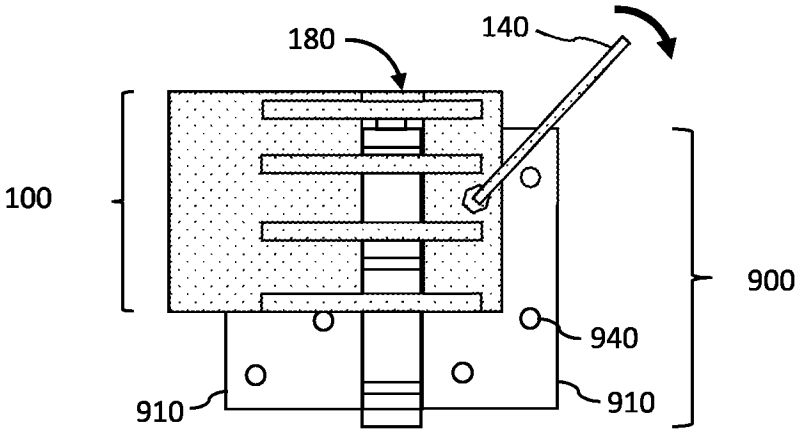
FIG. 10 illustrates an operation of the hinge arresting apparatus according to some embodiments.

Referring now to FIGS. 9-10. For example, hinge 900 is a typical hinge having one or more pins 930 (e.g., each having a pin top 920), knuckles 960, bearings 950, and leaves 910. Hinge 900 is typically mounted on to structures using one or more holes 940. Pins 930 are typically rods that hold leaves 910 together and are positioned within knuckles 960. In other embodiments, knuckles 960 are hollow (e.g., circular) structures that create the joint of leaf 910 through which pin 930 is set. In still other embodiments, knuckle 960 of either leaf 910 typically alternate and interlock with pin 930 passing through each hollow structure. Leaves 910 are the portions that typically extend laterally from knuckle 960 and typically revolve around pin 930.

In some embodiments, longitudinal face 240 is oriented towards leaves 910. For example, when hinge 900 is mounted to two different structures, to initiate operation of HAA 100, hinge slot 210 of each arresting rib 130 slides over pin 930, knuckles 960, and bearings 950 when leaves 910 are oriented 180 degrees relative to each other ("unfolded state"), ensuring the present invention is able to reduce the axial rotation of hinge 900. Aspects of HAA 100 include plate 180, which is peripherally affixed to longitudinal face 400 of a peripherally located arresting rib 130. In some embodiments, plate 180 inhibits HAA 100 from freely traversing hinge 900 by allowing pin top 920 to sit flush with plate 180 when HAA 100 is positioned over hinge 900. Since most traditional hinge knuckles are cylindrical in shape, in the current embodiment, hinge slot 210 is configured to have a substantially circular profile. However, embodiments enclosed herein are not limited to this option and hinge slot 210 may be configured to fit over other types of hinges.

Orifice 200 may or may not include internal threading (i.e. a continuous helical or spiral ridge or groove, around the inside of orifice 200). In some embodiments, threading for orifice 200 is provided for by nut 150 (e.g., a fastener with a threaded hole). In other embodiments, fastener 170 has an overall elongated structure, head 160, and threading 175, which complements the threading of nut 150. In certain aspects, handle 140 is affixed adjacent to head 160. In certain embodiments, subsequent to mounting HAA 100 over hinge 900, handle 140 is used to rotate and thereby extend fastener 170 through orifice 200. As fastener 170 rotates, the component extends through orifice 200 and contacts leaf 910 as it. As handle 140 rotates fastener 170, which now abuts leave 910, HAA 100 pivots away from hinge 900 thereby creating arresting friction between at least one of the copies of hinge slot 210 and hinge knuckle 960. The arresting friction is typically sufficient to frustrate attempts to remove (e.g., slidably disengage) HAA 100 from hinge 900.

Although the invention has been explained in relation to its preferred embodiment, it is to be understood that many other possible modifications and variations can be made without departing from the spirit and scope of the invention.

What is claimed is:

1. A hinge arresting apparatus comprising:

a first plate comprising a first longitudinal face;

a plurality of arresting ribs each comprising a first section, a second section, and a mid-section, the plurality of arresting ribs each oriented perpendicularly to and affixed to the first longitudinal face of the first plate;

a second plate comprising an orifice and a second longitudinal face affixed to the second section of each of the plurality of arresting ribs, the orifice comprising a threaded inner surface;

an elongated fastener positioned within the orifice and comprising a threaded external surface complementary to the threaded inner surface;

wherein each mid-section comprises a notch configured to transition over a hinge knuckle of a hinge; and the elongated fastener configured to extend through the orifice and contact a leaf of the hinge when rotated in a predetermined direction and thereby arrest an axial rotation of the hinge.

2. The hinge arresting apparatus of claim 1, wherein the orifice is positioned centrally on the second longitudinal face.

3. The hinge arresting apparatus of claim 1, wherein the elongate fastener is concentrically located within the orifice.

4. The hinge arresting apparatus of claim 1, wherein the notch comprises a tapered mouth sharing an orientation with a bottom longitudinal face of the first plate and configured to be positioned proximate to the hinge leaf when the notch is transitioned over the hinge knuckle; and the tapered portion configured to frictionally engage the hinge knuckle when the elongated fastener frictionally engages the leaf.

5. The hinge arresting apparatus of claim 1, wherein the plurality of ribs is positioned equidistant from each other.

6. The hinge arresting apparatus of claim 1, further comprising:

a handle;

wherein the fastener comprises an end affixed adjacent to the handle; and the handle is configured to facilitate axial movement of the fastener within the orifice.

7. The hinge arresting apparatus of claim 1, wherein the elongated fastener comprises a bolt affixed adjacent to an end of the bolt.

8. The hinge arresting apparatus of claim 1, wherein the orifice comprises a threaded fastener; and the threaded fastener comprises at least a portion of the threaded inner surface.

9. The hinge arresting apparatus of claim 1, wherein an arresting rib of the plurality of arresting ribs is positioned proximate to a lateral surface of the first plate and a lateral surface of the second plate;

comprises a lateral surface sharing an orientation with the lateral surface of the first plate and the lateral surface of the second plate; and wherein an arresting element is positioned proximate to the lateral surface of the arresting rib and configured to rest against a top surface of a pin traversing the hinge knuckle when the mid-section transitions over the hinge knuckle and thereby demountably affix the hinge arresting apparatus relative to the hinge.

* * * * *